United States Patent [19]

Sujata et al.

[11] Patent Number: 4,915,038

[45] Date of Patent: Apr. 10, 1990

[54] SUDDEN EXPANSION (SUE) INCINERATOR FOR DESTROYING HAZARDOUS MATERIALS AND WASTES AND IMPROVED METHOD

[75] Inventors: Mark L. Sujata, Agoura Hills; Raymond E. Wieveg, Ventura; Robert Wills, Torrance, all of Calif.

[73] Assignee: The Marquardt Company, Van Nuys, Calif.

[21] Appl. No.: 369,880

[22] Filed: Jun. 22, 1989

[51] Int. Cl.[4] ..... F23G 7/04

[52] U.S. Cl. ..... 110/346; 110/238; 110/190; 431/215; 431/284

[58] Field of Search ..... 110/238, 346, 190; 431/215, 284, 285

[56] References Cited

U.S. PATENT DOCUMENTS

| | | | |
|---|---|---|---|
| 4,255,122 | 3/1981 | Alpkvist et al. | 431/215 |
| 4,628,835 | 12/1986 | Wollner | 110/346 X |
| 4,705,022 | 11/1987 | Collier | 431/215 X |

*Primary Examiner*—Edward G. Favors
*Attorney, Agent, or Firm*—John J. Posta, Jr.

[57] ABSTRACT

The improved incinerator is a concentric elongated tubular array, with an outer closed tubular housing or shell, an annular tubular heat exchanger in the form of a bundle of spaced open ended tubes inside the housing and spaced inwardly therefrom to define an annular air passageway therebetween and front and rear spaces, and a tubular combustion chamber having an open front end and an open rear end. The front end thereof is necked down and in the form of a small diameter tubular inlet immediately downstream of the combustion zone in the combustion chamber. A fuel line, a fluidized waste material line and an ignition system pass through the inlet into the combustion zone, along with heated air to initiate and maintain the desired complete combustion of the waste material. The air is preheated by blowing it into the passageway and around and over the heat exchange tubes, before passing it into the combustion zone. The waste gases exit the housing through an exhaust stack at the front of the incinerator, which stack can be in heat exchange with the blower duct, in order to also heat the air and cool the exhaust gases. The incinerator operates, in accordance with the present method, with improved efficiency, requiring less fuel and producing fewer exhaust gases.

11 Claims, 2 Drawing Sheets

SUDDEN EXPANSION (SUE) INCINERATOR FOR DESTROYING HAZARDOUS MATERIALS AND WASTES AND IMPROVED METHOD

BACKGROUND OF THE INVENTION

1. Field of the Invention

The present invention generally relates to waste and hazardous materials and, more particularly, to an improved method and apparatus for completely incinerating such materials.

2. Prior Art

Hazardous materials and waste materials represent a serious challenge to human and animal health and to the environment in general. Recently, concerted efforts have been made to dispose of such materials in a safe manner, in many cases by dumping them in deep land fill zones. In other cases, hazardous materials are encased in protective containers and buried in land fills or at sea. Certain hazardous materials are also disposed of by burning them at trash dumps, in commercial furnaces and the like. Depending on the burning parameters, such destruction frequently is time-consuming, incomplete and produces noxious levels of undesired pollutants.

There remains a need for a simple, inexpensive, efficient method and apparatus for completely and rapidly incinerating hazardous and non-hazardous waste materials, particularly fluidizable materials, such as liquids, gases, entrained particles and slurries, without generating noxious by-products.

SUMMARY OF THE INVENTION

The improved method and waste incinerator of the present invention satisfy all the foregoing needs. The method and apparatus are substantially as set forth in the Abstract. Thus, the incinerator is a sudden expansion burner such as is currently used to produce high temperature gases for commercial heating and treating processes and testing facilities. One such burner is illustrated and described in U.S. Pat. No. 3,074,469. It has been discovered by applicants that such a gas-generating burner can be successfully used to completely consume hazardous and non-hazardous fluidized waste without producing noxious by-products such as nitrogen oxides and the like pollutants. U.S. Pat. No. 4,785,748 discloses an incinerator invented by the present inventors that successfully consumes vapor and fluidized waste material. Further significant efficienty of operation is now provided by the present incinerator and method.

In the present method, fluidized waste to be burned is injected as a stream into the front end of the incinerator through the small diameter cylindrical pipe inlet thereof and passes through that pipe, together with air heated by an annular heat exchanger in the form of a spaced bundle of heated charged tubes and blown to the inlet pipe. If the waste comprises fumes or a mass of small particles, it is entrained in air added to the fluidized waste supply line. The inlet pipe is concentric with and connected to the larger diameter cylindrical combustion chamber by a circular flat plate through which one or more fuel injection nozzles extend into the combustion chamber. The rear end of the combustion chamber is open.

The device also includes an electrically powered igniter extending through the pipe inlet to the combustion chamber and supplied with igniter fuel. Controls are provided for the igniter, air, fuel and waste supply systems.

The air blower of the device communicates through the outer concentric tubular housing of the device with an air passageway in which the heat exchanger is disposed. The tubes thereof are open ended to that waste gases flow therethrough from the rear to the front of the tubes for exhausting through a front stack in the heat exchange with the front blower. The combustion chamber is inside the heat exchanger.

Fuel is supplied to the upstream end of the combustion-chamber. If the waste is a liquid or gas capable of sustaining combustion at more than 5000 BTU's/lb., it can be premixed with the fuel and injected therewith, rather than separately. The sudden expansion between the smaller inlet pipe and the combustion chamber has the effect of acting as a flame holder, permitting stable and complete combustion of waste and fuel in the incinerator without generating products of incomplete combustion (PIC's) in significant concentrations. The fuel, air and waste while being consumed pass entirely through the elongated combustion chamber from the overstoichiometric area thereof to an understoichiometric downstream area. Highly reactive ions are generated in the combustion process to facilitate the more rapid and complete incineration of waste than in previous methods. Since the incoming air is heated more efficiently, less fuel is used than in the incinerator of U.S. Pat. No. 4,785,478 and less waste gas is generated.

The incinerator can be any suitable size and shape capable of producing the desired results, for example, a concentric tubular array, with the combustion chamber an inlet pipe as small as 3 inches in diameter, with the combustion chamber 6 inches in diameter, or an inlet pipe larger than 20 inches in diameter with the combustion chamber 40 inches in diameter. The overall combustion chamber and/or incinerator length can range from 1 to 30 feet in length.

Further features of the invention are set forth in the following detailed description and accompanying drawings.

DRAWINGS

FIG. 1 is a schematic side elevation, partly in section, and partly broken away, of a preferred embodiment of the improved incinerator of the present invention;

FIG. 2 is a schematic side perspective view of the combustion chamber, heat exchanger and outer housing of the incinerator of FIG. 1, separated from one another, the housing being shown without the exhaust stack and air blower thereof and with the front thereof open, the combustion chamber being shown without some of its supply lines; and, FIG. 3 is a schematic side perspective view of the components of FIG. 2, with the combustion chamber fully inserted in the heat exchanger and the heat exchanger partly inserted in the outer housing.

DETAILED DESCRIPTION

FIGS. 1-3

Figure 2:
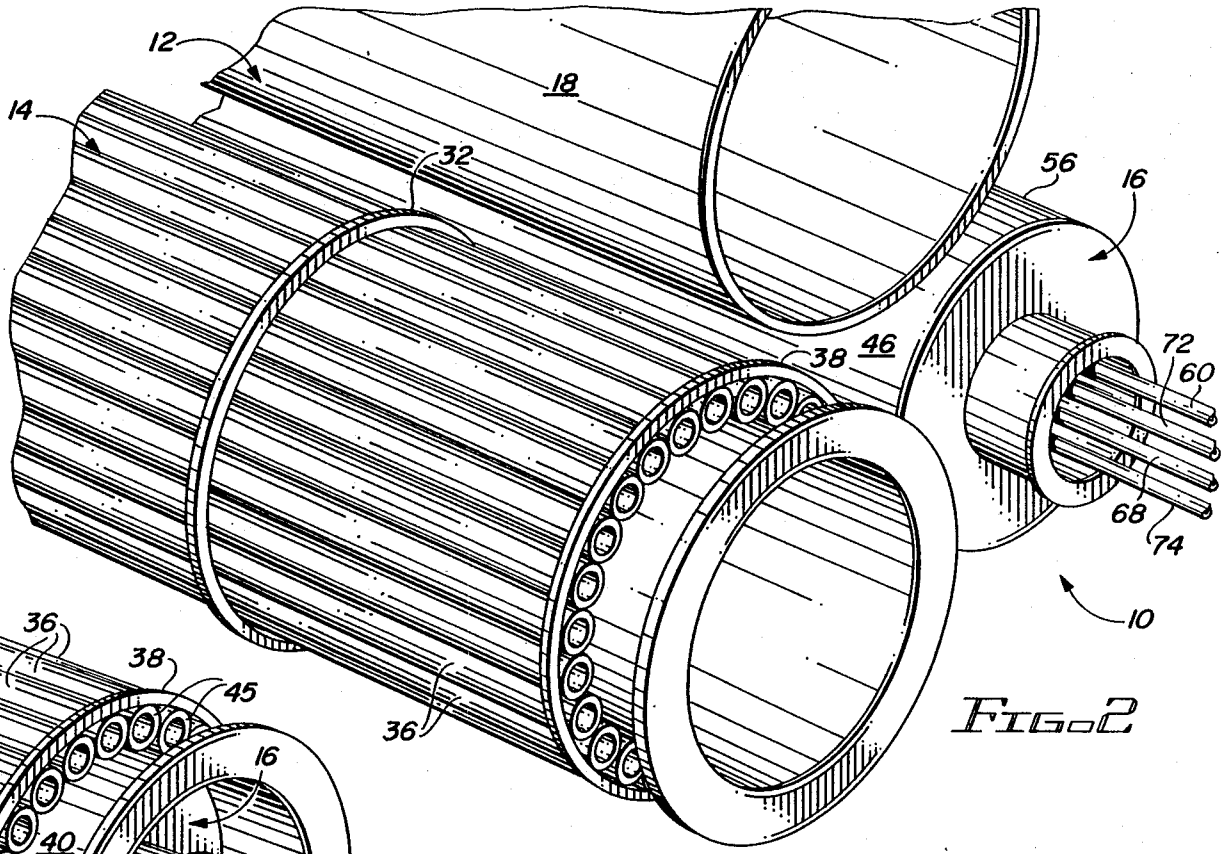
Figure 3:
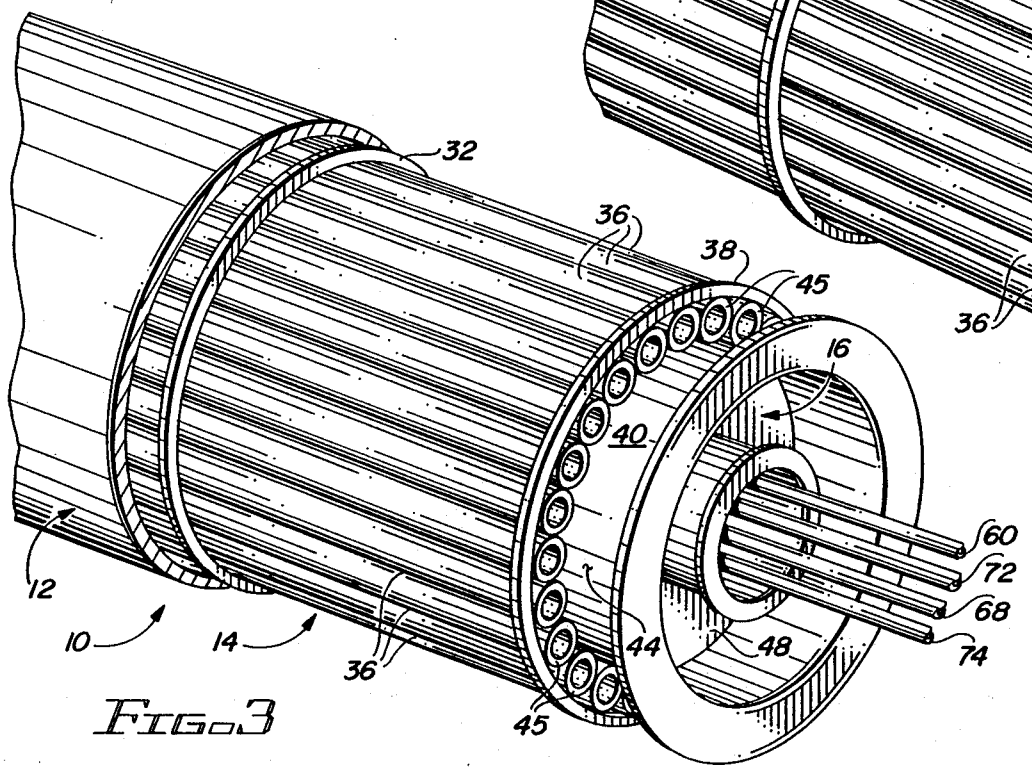

Now referring more particularly to the accompanying drawings, a preferred embodiment of the improved sudden expansion incinerator of the present invention is schematically depicted therein. Thus, incinerator 10 is shown, which comprises an outer hollow, tubular, preferably cylindrical, housing 12 of steel or the like high temperature metal or ceramic within which is releasably disposed a tubular heat exchanger 14 best seen in FIGS. 2 and 3. Inside heat exchanger 14 is disposed a hollow tubular combustion chamber 16. The components 12, 14 and 16 may be welded together.

Housing 12 comprises a cylindrical side wall 18 and closed front and rear end walls 20 and 22. The inlet duct 24 of an air blower 26 is disposed through sidewalls 18 adjacent front end 20. An exhaust gas stack 28 extends through sidewalls 18 in front of duct 24 and preferably in heat exchange therewith, so that exhaust gases 30 passing out through stack 28 are cooled by and heat air passing into incinerator 10 through duct 24 from blower 26.

Heat exchanger 16 is spaced inwardly of sidewall 18, as by one or more porous spacer rings 32 (FIGS. 1, 2 and 3) or the like, so as to define an annular passageway 34 between sidewall 18 and heat exchanger 16, with which passageway duct 24 communicates. Heat exchanger 16 comprises an annular bundle of separate, longitudinally extending, hollow, open ended thin, metallic tubes 36 of aluminum, copper, steel or the like, held spaced apart, as by ring 52 and front and rear collars 38 attached to tubes 36, so that air from passageway 34 can freely circulate therearound for maximum heat exchange therewith.

Heat exchanger 14 also includes a front extension tube 40 connected to front collar 38 and also connected to a second front collar 42 forward of collar 38. Front collars 38 and 42 and tube 40 may be integral. They define an annular groove 44 aligned with exhaust gas duct 28, allowing exhaust gases 30 to freely pass from the front ends 45 of tubes 36 through groove 44 to exhaust stack 28 and out of incinerator 10.

Figure 1:
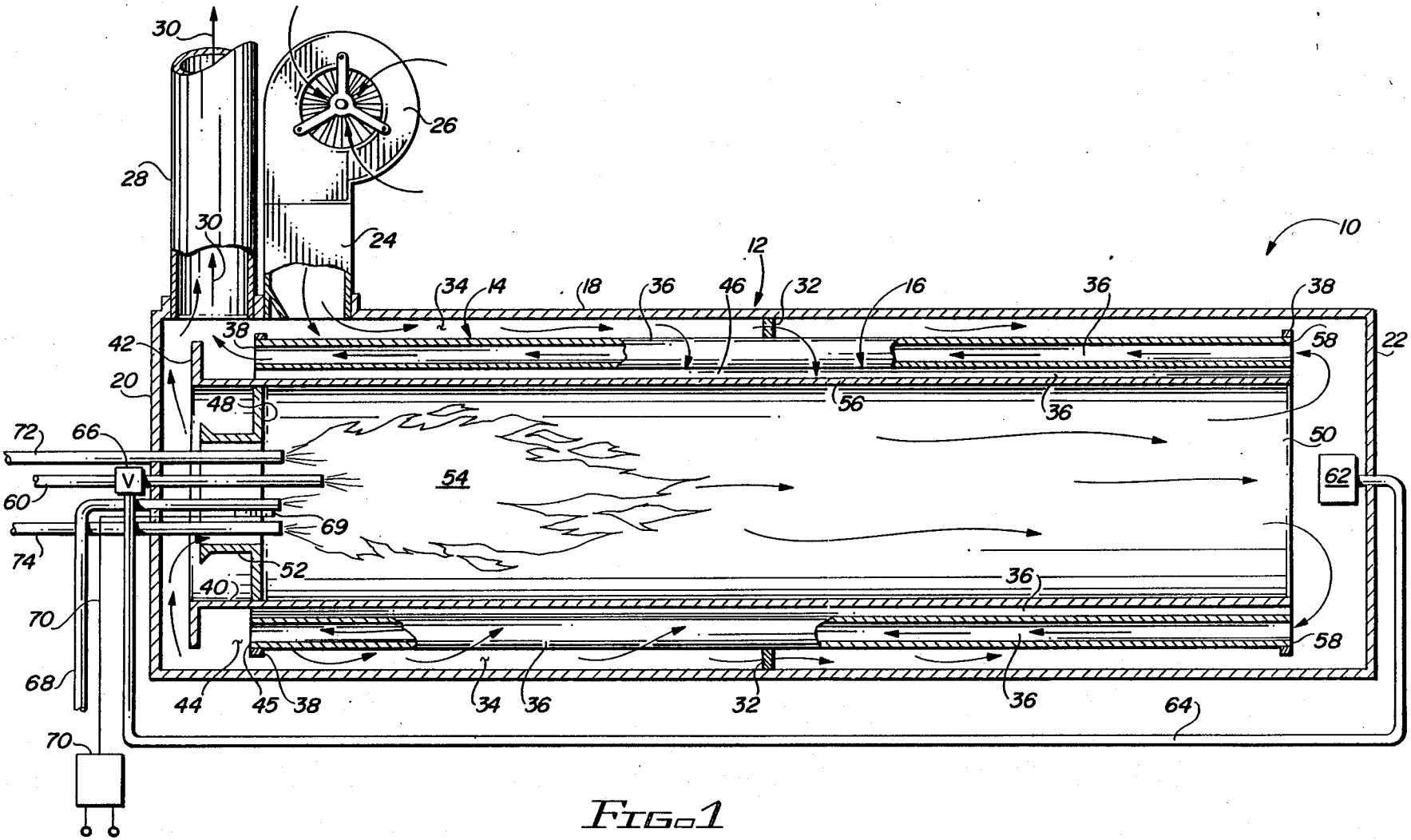

Combustion chamber 16 comprises an elongated hollow cylindrical steel or other high temperature metal tube 46 with open front inlet end 48 and rear outlet end 50. Front end 48 has a concentric necked down front pipe portion 52 just upstream of the combustion zone 54 in tube 46. Tube 46 is slideably received without heat exchanger 14 and, like heat exchanger 14, is spaced forwardly of rear wall 22, and rearwardly of front wall 20, as shown in FIG. 1. Thus, tube 46 is in heat exchange contact with exchanger 14 along the sidewall 54 of tube 46. Moreover, exhaust gases 30 from combustion zone 54 pass rearwardly out end 50 and into the rear ends 58 of heat exchanger tubes 36, then forwardly therein for exiting front ends 45 of tubes 36.

Incinerator 10 also includes supply and central means. Thus, it has a fuel supply line 60 running from a remote source into and through inlet end 48 and into combustion zone 54. Line 60 is interconnected to a thermocouple 62 in the rear of incinerator 10 by a line 64 running to a central valve 66 on line 60, so that the flow rate of fuel in line 60 is regulated in response to the temperature indicated by the thermocouple 62. An igniter fuel supply line 68 also runs from a remote source into combustion zone 54 through inlet 48, along with the igniter tip 69 of electrically powered igniter device 70, and one or more fluidized waste material supply lines 72 and 74. The fuel in line 60 can be a hydrocarbon such as propane or the like, as can the fuel in line 68.

Incinerator 10 is operated in accordance with the present method. Thus, incinerator 10 is started up by supplying igniter fuel through line 68 to combustion zone 54 and igniting it via tip 69 of device 70, while also supplying fuel through line 60 and fluidized waste material through line(s) 72 and/or 74 to zone 54. Air is supplied to zone 54 by operating blower 26, the air first flowing through duct 24 into passageway 34 and around heat exchanger tubes 36, and then forward thereof into and through inlet 48 to initiate and sustain the combustion.

The flow of fuel through line 60 is regulated by valve 66 in response to thermocouple 62, as previously indicated. As soon as combustion is well started, the hot exhaust gases 30 passing rearwardly in tube 46 and forwardly in tubes 36 heat the fresh incoming air from blower 26 so as to reduce the fuel necessary for the combustion reaction. The exhaust gases 30 may also heat exchange with the air in duct 24. Preferably, air is delivered to combustion zone 54 at a flow rate for an incinerator having a combustion chamber of about 12" diameter × 120" length, of about 800–1400 cu.ft./min. Obviously, the air flow rate and the waste material flow rate will vary according to the nature of the waste material, and the size and operating conditions of incinerator 10. Fuel such as methane, acetylene and other hydrocarbons can be used in addition to or in place of propane and can be supplied at any suitable flow rate, e.g., about 1.4–3.0 lbs./min. Because the incoming air to combustion zone 54 is highly heated, once combustion is underway, less fuel than previously is used.

Incinerator 10 is capable of self-sustaining combustion, particularly in view of the highly heated air, when the fluidized waste material to be consumed has a sufficiently high combustion heat output.

The supply can be shut off or greatly reduced after combustion is underway. The fluidized waste material for the self-sustaining combustion is usually a gas or liquid. Waste materials consumed by the incinerator can also include particles entrained in liquid and/or gases. Hazardous materials referred to herein can include any and all hazardous waste solid, liquid and gas materials, as well as hazardous materials it is desired to destroy, although they may not normally be considered as waste materials. The following specific examples illustrate certain features of the invention.

EXAMPLE I

In one specific example of the present method, the incinerator is constructed as shown with drawings and is all steel. The combustion chamber is a cylinder 12 inches in diameter × 120 inches long, with a 12" long necked down front portion which is 6 inches in diameter. Air passes into the combustion zone at a rate of about 1250 cu. ft./min., while propane passes to that zone initially at about 2.5 cu.ft./min. and later at a lower flow rate. The fuel-air mixture is ignited by a propane gas flame from an igniter. Thereupon, waste gas is passed into the combustion zone at the rate of about 1–5 lbs./min. Residence time of the waste material therein is about 0.12 seconds, with an average combustion temperature of about 2000° F.

Only contaminant-free gases are produced by the combustion and such gases highly heat incoming air via the heat exchanger tubes so as to greatly reduce the fuel requirement from 10–85 percent. The method and apparatus are safe, simple, inexpensive, durable and efficient.

EXAMPLE II

An incinerator similar to that of Example I employed in the present method, except that the incinerator has a combustion chamber of 20 inches × 200 inches plus a necked down front inlet portion of 10 inches × 20 inches. Waste fluid capable of sustaining combustion at more than 5000 BTU's/lb. is passed into the combustion zone, along with propane at an initial flow rate of about 5 lbs./min. and air at a flow rate of about 3500 cu.ft./-min. The waste residence time is about 0.12 seconds and the combustion temperature is about 2000° F. The fuel flow rate is gradually decreased and then stopped after combustion is fully sustained by the waste material, which combustion is aided greatly by the highly heated incoming air which has heat exchanged with the waste gases in the heat exchanger tubes and exhaust stack, the latter in heat exchange with the air inlet duct.

Various modifications, changes, alterations and additions can be made in the improved incinerator of the present invention, its components and parameters and in the present method, and the steps and parameters thereof. All such modifications, changes, alterations and additions as are within the scope of the appended claims form part of the present application.

What is claimed is:

1. An improved incinerator for hazardous and other waste materials, said incinerator comprising, in combination:

(a) a generally tubular elongated, outer housing having a sidewall, a closed front end, and an opposite closed rear end;

(b) a generally tubular elongated heat exchanger open at opposite front and rear ends, releasably disposed in said outer housing and spaced inwardly from said housing sidewall and end walls to provide an annular air passageway therebetween and front and rear spaces;

(c) a generally tubular combustion chamber releasably disposed within said heat exchanger, said combustion chamber being open at opposite front and rear ends thereof, including a narrow diameter front inlet end extending into said front space, and a combustion zone therein adjacent to said inlet end, said housing heat exchanger and combustion chamber being concentric;

(d) a fluidized waste material supply line connected to said housing and passing into said combustion zone through said inlet end;

(e) at least one fuel line and a fuel ignition device connected to said housing and passing into said combustion zone through said inlet;

(f) air blower means connected to the front portion of said housing for forcing air into said annular passageway and over and around said heat exchanger and thereafter in a heated condition to and through said front inlet end to said combustion zone, for efficient combustion of fluidized waste therein, exhaust gases from said combustion passing into the rear end of said heat exchanger and forwardly therethrough to the front end thereof; and, (g) exhaust gas exit means connected to said front portion of said housing for passing exhaust gases from said incinerator.

2. The improved incinerator of claim 1 wherein said incinerator includes temperature sensing means in said housing with said rear housing space, said sensing means being connected to fuel supply control means connected to said fuel supply line for regulating the temperature in said incinerator and for terminating the supply of fuel to said combustion zone whenever the combustion of said waste material therein is self-sustaining.

3. The improved incinerator of claim 1 wherein said heat exchanger comprises an annular bundle of spaced heat exchange tubes which permit air from said passageway to flow freely therearound for heating said air, thereby increasing the efficiency and lowering the fuel demand of said incinerator.

4. The improved incinerator of claim 1 wherein said exhaust gas exit means comprises a hollow tubular stack in heat exchange relation with said air blower means to facilitate heating of air when blown by said blower means towards said air passageway.

5. The improved incinerator of claim 1 wherein said incinerator is a sudden expansion burner adapted to receive and incinerate waste liquid, vapor fumes, entrained particles and slurries.

6. The improved incinerator of claim 5 wherein said fuel is hydrocarbon gas, wherein said incinerator operates at a combustion temperature of about 1800°–3500° F. and wherein the waste residence time in said incinerator combustion zone is about 0.08–0.12 seconds.

7. An improved method of incinerating fluidized waste material, said method comprising the steps of:

(a) separately passing fluidized waste material, fuel and air into the combustion zone in the front portion of a generally tubular combustion chamber having an open rear end, said combustion chamber being concentrically disposed in an annular open ended tubular heat exchanger, in turn concentrically disposed in and spaced inwardly of a tubular housing having closed front and rear ends to provide an annular passageway and front and rear spaces.

(b) initiating combustion of said fluidized waste material in said combustion zone;

(c) passing waste gases from said combustion through and out the rear of said combustion chamber into said rear space, and then into the rear of said heat exchanger and forwardly therein and out of said housing, while forcing air into said annular passageway, over and around said heat exchanger and then passing the resulting heated air into said combustion zone to increase the efficiency of said combustion; and, (d) continuing said combustion until a predetermined amount of said fluidized waste material is totally flame consumed in said incinerator without producing toxic or polluting gases.

8. The improved method of claim 7 wherein said heat exchanger comprises an annular bundle of spaced elongated tubes and wherein said air is passed over and around each of said tubes for improved heat exchange.

9. The improved method of claim 8 wherein the injection of fuel into said combustion zone is terminated when the combustion of said waste material becomes self-sustaining.

10. The improved method of claim 9 wherein said combustion gases are exhausted from said housing in heat exchange with air passing into said housing to preheat said incoming air.

11. The improved method of claim 9 wherein said fuel is hydrocarbon gas and wherein said waste material is capable of sustaining combustion at more than 5000 BTU's/lb.

* * * * *